US006147446A

United States Patent [19]

Pradere

[11] Patent Number: 6,147,446

[45] **Date of Patent: *Nov. 14, 2000**

[54] IMAGE CONVERTER TUBE WITH MEANS OF PREVENTION FOR STRAY GLIMMER

[75] Inventor: Philippe Pradere, Grenoble, France

[73] Assignee: Thomson Tubes Electroniques, Velizy, France

[ * ] Notice: This patent issued on a continued prosecution application filed under 37 CFR 1.53(d), and is subject to the twenty year patent term provisions of 35 U.S.C. 154(a)(2).

[21] Appl. No.: 08/178,748

[22] Filed: Jan. 7, 1994

[30] Foreign Application Priority Data

Jan. 22, 1993 [FR] France ..... 93 00638

[51] Int. Cl.[7] ..... H01J 31/50

[52] U.S. Cl. ..... 313/371

[58] Field of Search ..... 313/371, 106, 313/107, 529, 528, 527, 524

[56] References Cited

U.S. PATENT DOCUMENTS

| | | | |
|---|---|---|---|
| 3,474,275 | 10/1969 | Stoudenheimer et al. | 313/529 |
| 3,708,673 | 1/1973 | Blacker, Jr. | 313/528 |
| 4,001,618 | 1/1977 | Kaseman | 313/529 |
| 4,045,700 | 8/1977 | Wulff | 250/213 VT |
| 4,069,357 | 1/1978 | Miller et al. | 427/123 |
| 4,173,727 | 11/1979 | Vine | 313/529 |
| 4,221,967 | 9/1980 | Wang et al. | 250/213 VT |
| 4,315,184 | 2/1982 | Santilli et al. . | |
| 4,862,006 | 8/1989 | Vieux et al. | 250/213 VT |
| 4,960,987 | 10/1990 | Frank | 250/213 VT |

FOREIGN PATENT DOCUMENTS

| | | |
|---|---|---|
| 0 360 906 | 4/1990 | European Pat. Off. . |
| 0 380 147 A1 | 8/1990 | European Pat. Off. . |
| 0 406 869 B1 | 1/1991 | European Pat. Off. . |
| 24 61 262 A1 | 7/1976 | Germany . |
| 29 09 066 A1 | 9/1979 | Germany . |
| 38 33 133 C2 | 4/1990 | Germany . |
| 42 08 538 A1 | 9/1993 | Germany . |

OTHER PUBLICATIONS

A.R. Nyaiesh, R.E. Kirby, F.K. King and E. L. Garwin "New radio frequency technique for deposition of hard carbon films"; 1985 Vacuum Society J. Vac. Sci. Technol. A3 (3), May/Jun. 1985; Pp. 610–613.

T.L. Bekker, J.A. Dayton, Jr., A.S. Gilmour, Jr., I.L. Krainsky, M.F. Rose, R. Rameshan, D. file, and G. Mearini "Observations of secondary electron emission from diamond films"IEEE, I.B. Johnson, Phys. Rev. 92, p.843(1953), IEDM 92–949 TO 92–952. 1992 (no month).

*Primary Examiner*—Sandra O'Shea
*Attorney, Agent, or Firm*—Oblon, Spivak, McClelland, Maier & Neustadt, P.C.

[57] ABSTRACT

Disclosed is an improvement in image converter tubes that convert the X-ray image given by their input screen into a visible image. Stray glimmer develops on the insulators inside these tubes and the disclosure makes it possible to eliminate this glimmer by the deposition, on the insulators, of a thin layer of a product such as diamond-like carbon having a low secondary electron emission rate. Metal oxides are also suitable for this purpose. Application to image intensifiers.

7 Claims, 1 Drawing Sheet

IMAGE CONVERTER TUBE WITH MEANS OF PREVENTION FOR STRAY GLIMMER

BACKGROUND OF THE INVENTION

1. Field of the Invention

The present invention relates to an improvement in image converter tubes: this improvement enables the elimination of the stray glimmer or glow that can develop on the insulators inside these tubes.

The invention also relates to a method implemented to eliminate this unwanted or stray glimmer.

A preliminary reminder of the structure and working of an image converter tube will provide for a clearer understanding of the nature of the problem posed and that of the solution proposed by the invention. However, more clearly and specifically, the explanations as well as those pertaining to the invention will be based, for example, on the non-restrictive example of a radiological image intensifier tube.

2. Description of the Prior Art

Image intensifier tubes are vacuum tubes comprising an input converter, placed in the front of the tube, an electronic optical system and a screen for the observation of the visible image placed in the rear of the tube, on the output window side of this tube.

In radiological image intensifier tubes (abbreviated as RII tubes), the input converter comprises a scintillator screen that converts the incident X photons into visible photons.

FIG. 1 shows a schematic view of a radiological type of image-intensifier tube such as this.

The RII tube comprises a glass or metal casing 1 of which one end, in front of the tube, includes an input screen 2. This end is closed by an input window 3 exposed to a radiation of X photons.

The second end of the casing forming the rear of the tube is closed by an output window 4 that is transparent to light.

The X-rays are converted into light rays by a scintillator screen 5. The light rays excite a photocathode 6 which produces electrons in response.

The electrons produced by the photocathode 6 are accelerated towards the output window 4 by means of different electrodes 7 and an anode 8, that is positioned along a longitudinal axis of the tube and forms the electronic optical system.

The output window 4 is formed by a transparent glass element which, in the example shown, bears a cathodoluminescent tube or output screen 9 formed by luminophors for examples.

The impact of the electrons on the cathodoluminescent screen or output screen enables the reconstitution of an image (amplified in luminance) which was initially formed on the surface of the photocathode 6.

The image displayed by the output screen 9 is visible through the glass element that constitutes the output window 4. Generally, optical sensor devices (not shown) are positioned outside the tube in the vicinity of the output tube 4 to pick up this image through the output window 4 and enable its observation.

However, this observation can be efficient only if no stray light comes into play. Now, one consequence firstly of the manufacturing method and, secondly, of the high voltages of the electronic optics, lies in the appearance of glimmer on the surface of the insulating parts that support the electrodes. It can easily be imagined that this glimmer lowers the quality of the radiological image observed, especially in terms of contrast.

This stray glimmer arises out of the fact that the quality of the electrical insulation of the electrodes is lowered by the presence of the alkaline metals that are deposited on the electrodes and which, by field effect, foster an emission of electrons that will charge the insulators.

SUMMARY OF THE INVENTION

The invention provides a solution to the prior art drawbacks by proposing to limit the electrical charge of the insulators, which is the cause of the stray glimmer. This objective is achieved by covering the surface of the insulators with a thin layer of a product that has very low conductivity to limit the leakage current but above all has a low secondary electron emission rate. Diamond-like carbon is a good example of a substance that is suited to these imperatives.

More specifically, the invention relates to a radiological image intensifier (RII) tube comprising, within a vacuum chamber, at least one input screen associating a scintillator and a photocathode that convert the X-rays incident to the scintillator into electrons focused on an output screen by means of an electronic optical unit formed by a plurality of electrodes fixed by means of a plurality of insulating parts, this RII tube being being one wherein, in order to eliminate the stray glimmer that arises during operation on the insulators, these insulators are covered with a thin layer of a material that has a low secondary electron emission rate and very low electrical conductivity, and is capable of being deposited by a physical or chemical method of vapor deposition in thin layers.

BRIEF DESCRIPTION OF THE DRAWING

The invention will be understood more clearly from the description of an exemplary embodiment, made with reference to the appended drawings, of which.

MORE DETAILED DESCRIPTION

Figure 1:
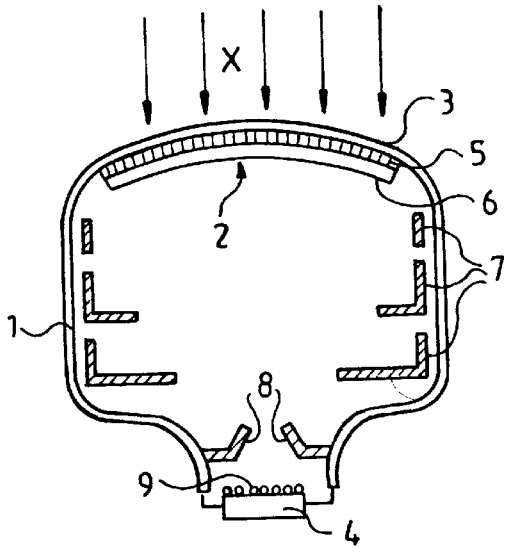
FIG.1 PRIOR ART
FIG. 1 shows a schematic sectional view of a prior art RII tube.
Figure 2:
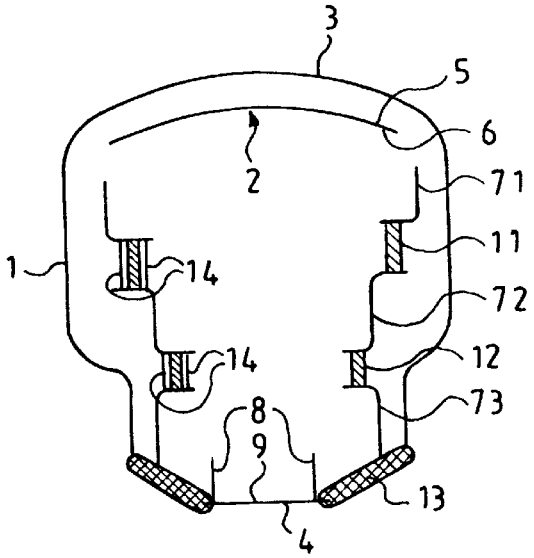
FIG. 2 shows a sectional view of an RII tube oriented to the problems of insulators resolved by the invention.

FIG. 1, described here above, gave a quick view of the operation of an RII tube. FIG. 2 repeats this sectional view but is more particularly oriented to the internal electrical insulation.

In order to make the description clearer and more concrete, it will be assumed that this RII tube is a photocathode 6 made of alkaline antimonide and that it is of a tetrode type, with three gates 71, 72, 73 and one anode 8.

The electrodes are taken to voltages that may exceed 30 kV for the anode 8 and about 20 kV for the gate 73. The electrodes 71 and 72 are taken to voltages that generally do not exceed 1500 V. The primary screen 2 with its photocathode 6 converts the X-radiation into an electron beam that is then focused by the set of electrodes on to the secondary screen 4 which converts it into light images. Generally, the anode 8 is taken to a fixed voltage, for example equal to 30 kV, while the other electrodes, especially the gate 73, can be taken to variable voltages to enlarge the input image on the output screen, thus creating a zoom effect. The zoom operating mode may lead to operating voltages of over 20 kV for the electrode 73.

The set of gates 71, 72 and 73, of the anode 8 and of the output window 4, form an architectural assembly that is rigidly assembled:

firstly, by means of alumina shims 11 and 12, for example between the gates 71, 72 and 73;

secondly, by means of a glass/metal seal 13, between the casing 1 of the tube and the electrodes 8 and 73.

Figure 3A:
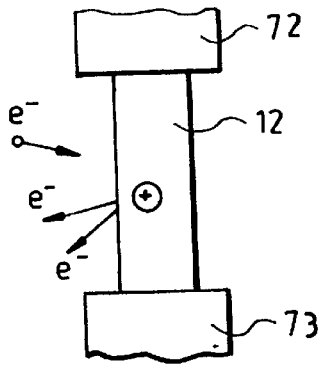
FIGS. 3*a*, 3*b* and 3*c* are diagrams showing the mechanism of the appearance of glimmer on insulators.
Figure 3B:
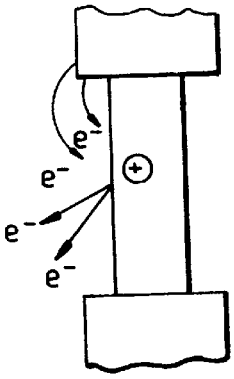
Figure 3C:
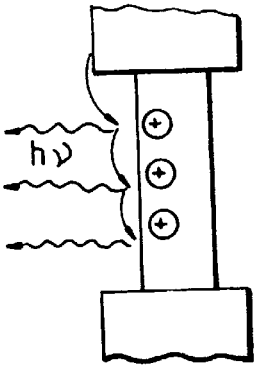

In view of the high voltages at which the electrodes 73 and the anode 8 may work, their electrical insulation from the rest of the tube raises a difficult problem, but it happens that the behavior under voltage is particularly downgraded by the method of manufacture of the photocathode which is done from the very interior of the vacuum tube 1 by successive vapor depositions of its constituent elements. While the vapor deposition of antimony (Sb) by Joule effect using a crucible inserted in the axis of the tube is a directive process and enables the prevention of high pollution in the rest of the tube, the situation is quite different for the vapor deposition of alkali metals such as potassium (K), cesium (Cs) or sodium (Na). The vapor deposition of the alkali metals is the result of a decomposition, under heat, of a compound of these metals such as, for example, a chromate, by heating by Joule effect of the alkaline generators. The closed geometry of these generators, which is necessary for the confinement of the chromates to optimize the reactions of decomposition, and their off-centered position with respect to the axis of the tube, give the vapor deposition very low directivity. The vapor deposition of the alkaline materials may even be done outside the tube: they are then injected into the tube through a stem. In any case, this vapor deposition generates a mist that gets deposited everywhere inside the tube A part of the alkali metals gets deposited on the metal parts of the RII tube such as the electrodes 71, 72, 73 while another part of the alkali metals gets deposited on the insulator parts 11, 12, 13. FIGS. 3*a* to 3*c* enable an understanding of the phenomenon of the appearance of glimmer on insulators and consequently an understanding of the solution provided by the invention.

Let us take an insulating part 12, made of alumina, that supports and joins two gates 72 and 73 made of stainless steel, for example. In this case, the gate 73 is taken to some 20 kV, the gate 72 to some 1.5 kV and the alumina shim 12 has been previously polluted by alkali metals as is the case also with the metal elements.

The alkali metals, deposited on the surface of the internal metal parts of the tube, considerably diminish the electron work function of the metal. This fact promotes the stray emission of electrons by field effect at the places where the electrical field is strong. In particular, the electrical field may be very strong in the vicinity of the insulator and low voltage electrode for reasons related to the charge of the insulator and the proximity of potential sources of electrons.

Thus, in a first mechanism of emission shown in FIG. 3*a,* an incident electron that strikes the alumina shim 12 prompts a multiplier effect and liberates at least two secondary electrons from this shim, the consequence of which is that the shim 12 is charged with at least one positive charge. This positive charge, in a second mechanism of emission shown in FIG. 3*b,* attracts the electrons that have come out of the metal parts by field effect, for example in the neighborhood of the insulator/electrode. The electrons thus picked up imply a return to the preceding case and create secondary electrons by the multiplier effect. It is thus that, very soon, there is an avalanche effect and the emission of electrons by field effect leads (FIG. 3*c*) to the appearance of glimmer on the surface of the bombarded insulator by a cathodoluminescence type of mechanism. This glimmer is typically blue on glass and red on alumina $Al_2O_3$. The flashes of glimmer are generally stable in time although they may vary slightly in position.

The glimmer on the surface of the insulators, which is visible directly from the photocathode or by reflections on the electrodes or the metal walls of the tube, is retransmitted and amplified on the secondary screen 4. The stray illumination thus generated disturbs the efficient operation of the RII tube, causing glimmer when there is no useful signal and deterioration of the contrast during operation. The substantial leakage current that may be associated with the presence of the glimmer is a source of instability of the supply of the RII tube to the detriment of the quality of the image, with a loss of resolution.

To improve the electrical insulation and, in particular, to limit the appearance of glimmer on the surface of the insulators, different approaches are known but these approaches either entail limitations of performance characteristics or remain very costly.

A first approach consists in limiting the possibilities of electron emission. This approach calls for action on the configuration of the parts and their surface condition. Indeed, the stray emission of electrons by field effect is governed by two parameters: the electron work function and the microscopic field at the surface of the emission site. While the work function is conditioned by inevitable presence of alkal metals, the microscopic field may be diminished by improving the surface condition and by increasing the radius of curvature at the possible sites of emission, with a diminishing of the point or tip effect. The stray emission of electrons and, hence, the glimmer on insulators may therefore be reduced by the introduction of polished and rounded parts, for example at the insulator/metal junctions. These parts are generally costly and have to be handled with care.

In a second approach, the bombarded insulator is protected by means of a deposition of a powdery product. Such an approach consists, for example, in a chromium oxide deposit, formed by using a mixture of chromium oxide powder, water and, possibly, a binder. The deposit is applied with a brush or pad and gives a thick deposit with low adhesion. While this approach makes it possible to eliminate glimmer on the surface of the brushed-over insulator, it is a particular source of pollution in the tube and hence a source of defects of appearance on the output screen.

Finally, it is possible to optimize the form of the insulator by using crenellated or conical aluminas. This is a costly approach, with limited efficiency owing to the presence of alkaline substances in the tube.

According to the invention, the electrical charge of the insulators, which is the cause of the stray glimmer, is limited by a deposit 14 (FIGS. 2 and 4) on these insulators of a product having the following main characteristics:

having a low secondary electron emission rate so that, if it is struck by an electron, it absorbs it without secondary emission, with multiplication;

being homogeneous, i.e. non-powdery, or deposited by a so-called "thin layer" method with high adhesion between the product and the insulator;

having very low conductivity to limit the leakage current in the image intensifier tube.

A deposition such as this consists, for example, of a layer of amorphous carbon deposited by cathode sputtering or by a method of plasma enhanced chemical vapor deposition (PECVD). The PECVD technique makes it possible to obtain a homogeneous, thin, insulating and highly adhesive deposit on parts having complex shapes. The deposition consists of an operation for the cracking, on the surface of the substrate, of acetylene in the presence of hydrogen at low pressure ($10^{-1}$ to $10^{-3}$ torr). To activate the reaction, the substrate is heated to 100° C. and subjected to a high-frequency plasma of 13.5 MHz. This type of thin layer is also known as amorphous diamond-like carbon or ADLC.

Amorphous diamond-like carbon is a material known for its low secondary emission coefficient. This coefficient remains below 1 irrespective of the incident energy of the electrons. The material does not get charged, whatever the conditions of electron bombardment.

Carbon in the form of graphite is not appropriate because it is conductive. The black of the carbon has been used in vacuum tube technology but this type of deposition has all the drawbacks of chromium oxide paint: thickness, poor adhesion and, hence, the possibility of generating particles in the tube.

Amorphous diamond-like carbon deposited in thin layers by sputtering or by PECVD is perfectly homogeneous and adheres to its support. It does not generate any dust like chromium oxide paint.

The deposition of carbon by PECVD enables the processing of a large number of parts simultaneously. A thickness of 1000 Å(0.1 $\mu$m) is sufficient to gain a factor of 1.5 to 2 on the threshold of appearance of the glimmer on the surface of alumina insulators working at voltages that may go up to 40 kV. This is because diamond-like carbon has low conductivity and takes very high voltages.

The deposition of amorphous carbon can be done on alumina parts such as insulators 11 and 12 between the electrodes 72 and 73 for example or on a glass bulb 13 that enables the insulation between the gate 73 and anode 8. The adjoining metal parts such as the tips of the alumina shims or the metal parts molded in the glass bulb may also be covered, the deposition being also adhesive on a metal substrate, and not liable to generate particles during the mounting operations owing to its small thickness.

Figure 4:
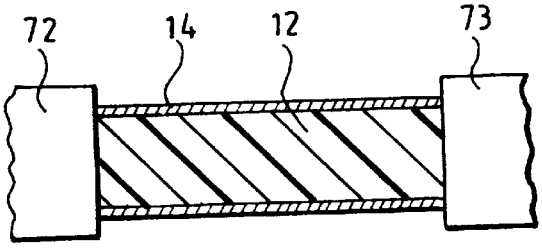
FIG. 4 shows a sectional view of an insulator covered with a thin layer according to the invention.

FIG. 4 illustrates the invention: an insulating shim 12, located between two metal parts such as the electrodes 72 and 73, is covered with a layer 14 of a material having a low secondary emission rate and low conductivity, deposited according to a so-called thin layer technique.

As compared with the insulating shim 12, the layer 14 behaves like a sheathing to prevent incident electrons from charging the insulator 12 by secondary electron emission.

The invention can be extended to any other type of insulating material that is capable of being deposited in the thin layer and has, as its main characteristic, a low secondary electron emission rate. Examples of such materials are the oxides of titanium, tungsten, vanadium, molybdenum, silver, copper or even chromium oxide in thin layers. In this case, the chromium is deposited, for example, by cathode sputtering with a device for the rotation of the sample to homogenize the deposit, and the deposit is then oxidized.

The invention is specified by the following claims.

What is claimed is:

1. An image converter tube including a vacuum chamber and within the vacuum chamber comprising:

an input screen including a scintillator and a photocathode, for converting input X-rays into electrons;

an output screen for receiving the electrons generated by the input screen;

an electronic optical unit for focusing the electrons onto the output screen, the electronic optical unit comprising:

a plurality of electrodes;

a plurality of insulating parts fixing the plurality of electrodes; and a thin layer of amorphous diamond-like carbon formed to cover the plurality of insulating parts.

2. The image converter tube according to claim 1, wherein the thin layer is formed by cathode sputtering.

3. The image converter tube according to claim 1, wherein the thin layer is formed by chemical vapor deposition.

4. The image converter tube according to claim 1, wherein the thin layer has a thickness of 1000 Å.

5. The image converter tube according to claim 2, wherein the thin layer has a thickness of 1000 Å.

6. The image converter tube according to claim 3, wherein the thin layer has a thickness of 1000 Å.

7. The image converter tube according to claim 3, wherein the thin layer is formed by plasma enhanced chemical vapor deposition.

* * * * *